US009089468B2

(12) United States Patent
Wang

(10) Patent No.: US 9,089,468 B2
(45) Date of Patent: Jul. 28, 2015

(54) TILTING INVERSION EXERCISER HAVING SAFETY FOOT RETAINING DEVICE

(75) Inventor: Lo Pin Wang, Taichung (TW)

(73) Assignee: Beto Engineering & Marketing Co., Ltd., Beitun, Taichung (TW)

( * ) Notice: Subject to any disclaimer, the term of this patent is extended or adjusted under 35 U.S.C. 154(b) by 326 days.

(21) Appl. No.: 13/200,661

(22) Filed: Sep. 28, 2011

(65) Prior Publication Data

US 2013/0079204 A1 Mar. 28, 2013

(51) Int. Cl.
*A61H 1/02* (2006.01)

(52) U.S. Cl.
CPC ..... *A61H 1/0222* (2013.01); *A61H 2201/0161* (2013.01); *A61H 2201/1642* (2013.01); *A61H 2203/0493* (2013.01)

(58) Field of Classification Search
CPC ..... A61H 2203/0493; A63B 2069/0062
USPC ..... 482/144
See application file for complete search history.

(56) References Cited

U.S. PATENT DOCUMENTS

| | | | | |
|---|---|---|---|---|
| 2,314,411 | A * | 3/1943 | Lyon | 226/33 |
| 3,286,708 | A * | 11/1966 | Gartner | 601/5 |
| 5,718,660 | A | 2/1998 | Chen | |
| 7,077,795 | B2 * | 7/2006 | Chen | 482/145 |
| 7,081,073 | B1 * | 7/2006 | Smith | 482/145 |
| 7,118,518 | B1 | 10/2006 | Teeter | |
| 7,322,911 | B2 * | 1/2008 | Webber | 482/142 |

* cited by examiner

*Primary Examiner* — Loan H Thanh
*Assistant Examiner* — Rae Fischer
(74) *Attorney, Agent, or Firm* — Charles E. Baxley

(57) ABSTRACT

A tilting inversion exerciser includes a table rotatably supported on a supporting stand, a foot support attached to an extension of the table, a carrier attached to the extension, and a foot retaining device having a lever pivotally attached to the carrier, a foot anchor device attached to the lever and movable toward and away from the foot support of the extension, a latch member attached to the lever for engaging with the carrier and for adjustably anchoring the lever and the foot anchor device to the foot support of the extension at a selected angular position, and a lock device for locking the latch member to the lever and for giving some security to the user while conducting the inversion exercises.

10 Claims, 11 Drawing Sheets

TILTING INVERSION EXERCISER HAVING SAFETY FOOT RETAINING DEVICE

BACKGROUND OF THE INVENTION

1. Field of the Invention

The present invention relates to a tilting inversion exerciser, and more particularly to a tilting inversion exerciser having a rotating ankle holder or foot retaining device for detachably securing the ankle portions or the feet of the user to the foot retaining device of the tilting inversion exerciser, and for giving some security to the user while conducting the inversion exercises, and for preventing the feet of the user from being disengaged from the foot retaining device inadvertently.

2. Description of the Prior Art

Typical tilting inversion exercisers comprise a base or table pivotally or rotatably supported on a lower support stand for supporting a user thereon, and for allowing the user to tilt or to incline the table relative to the lower support, in order to conduct the typical tilting inversion exercises, and comprise an ankle holder or foot retaining device attached to the table for detachably securing the ankle portions of the user to the table of the tilting inversion exerciser and for preventing the feet of the user from being disengaged from the foot retaining device inadvertently.

For example, U.S. Pat. No. 5,718,660 to Chen, U.S. Pat. No. 7,077,795 to Chen, U.S. Pat. No. 7,081,073 to Smith, and U.S. Pat. No. 7,118,518 to Teeter disclose several of the typical tilting inversion exercisers each also comprising a base or table pivotally or rotatably supported on a lower support for supporting a user thereon, a foot rest or ankle holder or foot retaining device attached to the table for detachably securing the ankle portions of the user to the table of the tilting inversion exerciser, and a handle pivotally attached to the foot rest for being rotated relative to the foot rest to clamp and to stably lock and retain the feet of the user to the base or table.

However, the ankle holder or foot retaining devices have no locking devices or mechanism to lock the foot retaining devices in place, and the foot retaining devices of the typical tilting inversion exercisers may be conducted or actuated or operated inadvertently by children, for example, and the feet of the user may have a good chance to be disengaged from foot retaining device and the base or table particularly when the base or table is inverted, such that the user may also have a good chance to be disengaged from base or table inadvertently.

The present invention has arisen to mitigate and/or obviate the afore-described disadvantages of the conventional foot retaining devices for the tilting inversion exercisers.

SUMMARY OF THE INVENTION

The primary objective of the present invention is to provide a tilting inversion exerciser including a rotating ankle holder or foot retaining device for detachably securing the ankle portions or the feet of the user to the foot retaining device of the tilting inversion exerciser and for giving some security to the user while conducting the inversion exercises and for preventing the feet of the user from being disengaged from the foot retaining device inadvertently.

In accordance with one aspect of the invention, there is provided a tilting inversion exerciser comprising a supporting stand, a table rotatably supported on the supporting stand with a pivot axle for supporting a user on the table, and including an extension extended therefrom, and including a foot support attached to the extension, and including a carrier attached to the extension, and a foot retaining device including a lever pivotally attached to the carrier with a pivot spindle, and including a foot anchor device attached to the lever and movable toward and away from the foot support of the extension with the lever when the lever is pivoted relative to the carrier, a latch member attached to the lever for selectively engaging with the carrier and for adjustably anchoring the lever and the foot anchor device to the foot support of the extension at a selected angular position, and a lock device for selectively locking the latch member to the lever and for preventing the latch member from being moved relative to the lever.

The carrier includes a channel formed therein for slidably receiving and engaging with the latch member, and includes a plurality of depressions formed therein and communicative with the channel thereof for selectively engaging with the latch member and for adjustably anchoring the lever and the foot anchor device to the foot support of the extension at the selected angular position.

The carrier includes two carrier panels spaced from each other for forming a compartment between the carrier panels and for pivotally engaging with the lever. The carrier panels each include the channel and the depressions formed therein.

The channel of the carrier is a curved channel having a curvature center located at the pivot spindle. The lever includes an opening formed therein for slidably receiving and engaging with the latch member.

The foot retaining device includes a rotary member pivotally attached to the carrier with the pivot spindle and coupled to the lever. The rotary member includes an oblong hole formed therein and aligned with the channel of the carrier for slidably receiving and engaging with the latch member.

The carrier includes a foot pedal attached to the carrier with a beam, and the rotary member includes a curved notch formed therein for slidably engaging with the beam and for limiting the rotary member to rotate relative to the carrier.

The rotary member includes a curved slot formed therein, and the carrier includes a pin member attached thereto and slidably engaged through the curved slot of the rotary member for limiting the rotary member to rotate relative to the carrier.

The foot retaining device includes a sliding member slidably received and engaged in the lever, and the latch member is attached to the sliding member and includes an enlarged head engaging with the carrier and for preventing the latch member from being disengaged from the channel and the depressions of the carrier.

The lever includes a spring biasing member engaged with the sliding member for biasing and forcing the latch member to engage with either of the depressions of the carrier. The foot retaining device includes a stem slidably engaged in the lever and secured to the sliding member and moved in concert with the sliding member for moving the sliding member along and relative to the lever.

The foot retaining device includes an actuating member attached to the stem for anchoring and supporting the lock device. The lock device is pivotally mounted to the lever with a pivot shaft and includes a lock member for selectively engaging with the actuating member and for locking the lock device to the actuating member and the lever.

The lever includes a cap attached thereto and having a hole formed therein for slidably engaging with the stem and arranged for forming a space between the actuating member and the cap and for selectively engaging with the lock member.

The lock device includes a first engaging member provided therein, and the actuating member includes a second engaging member provided therein for engaging with the first engaging member of the lock device and for locking the lock device to the actuating member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
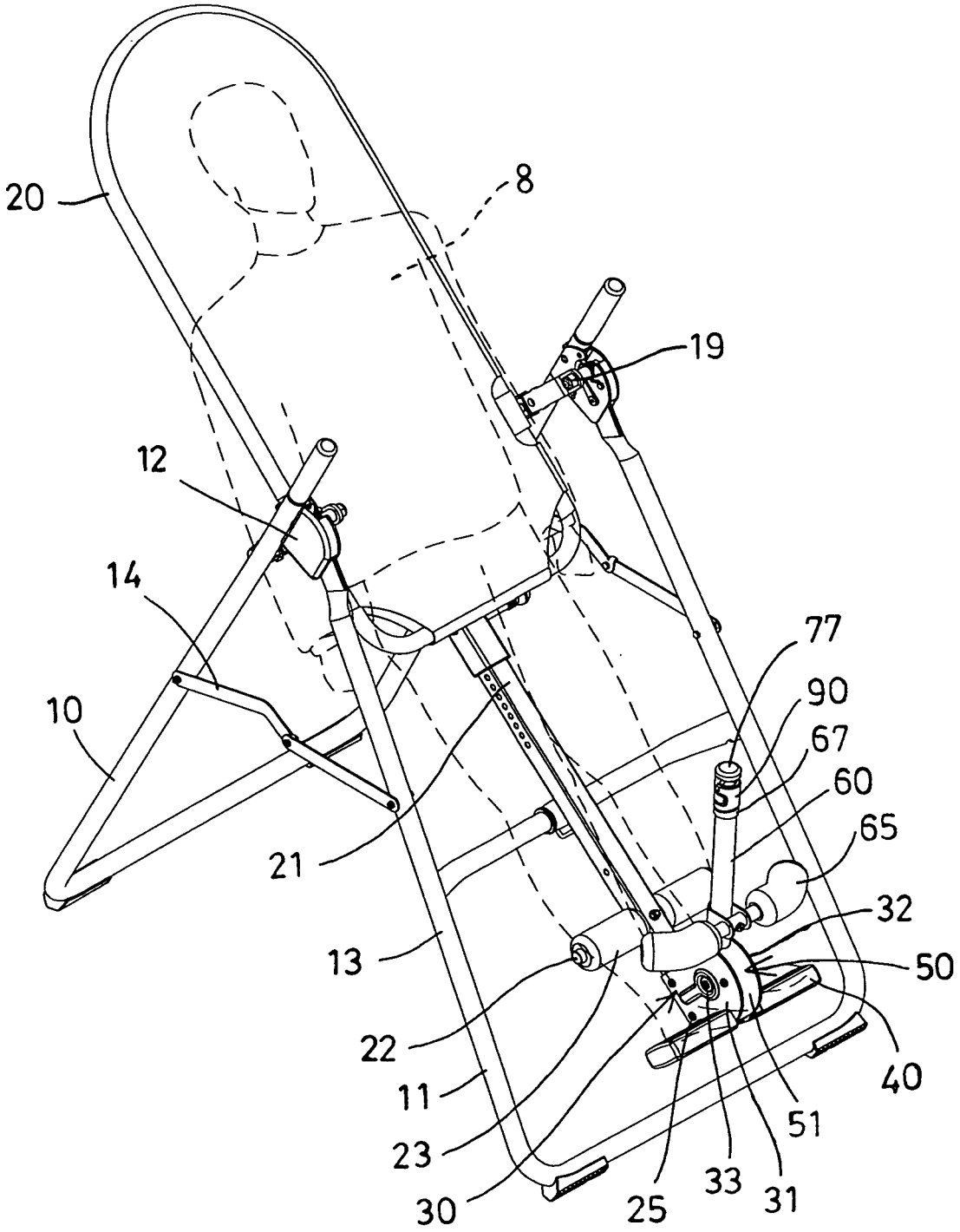
FIG. 1 is an upper perspective view of a tilting inversion exerciser in accordance with the present invention.
Figure 2:
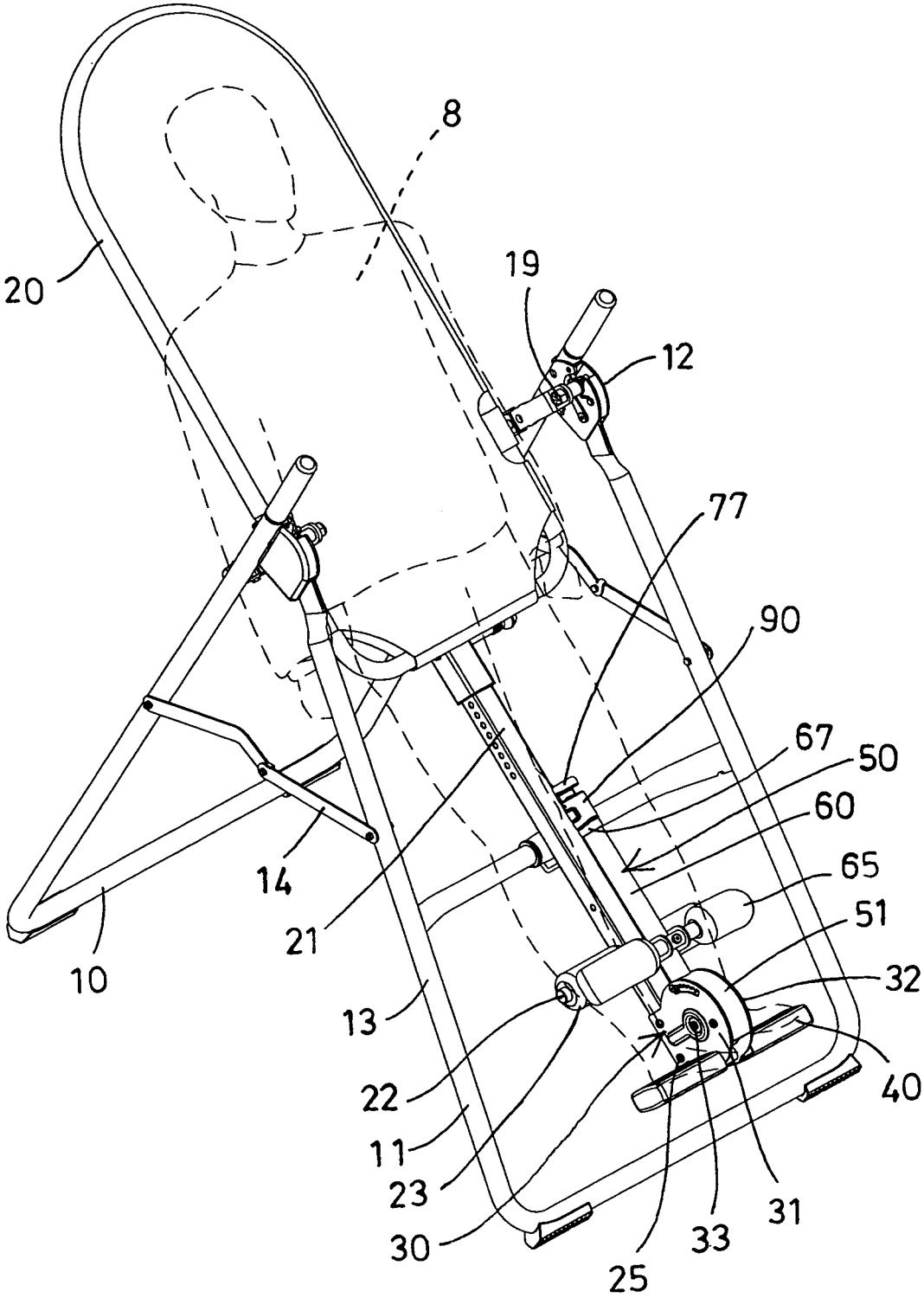
FIGS. 2, 3 are other upper perspective views similar to FIG. 1, illustrating the operation of the tilting inversion exerciser.
Figure 3:
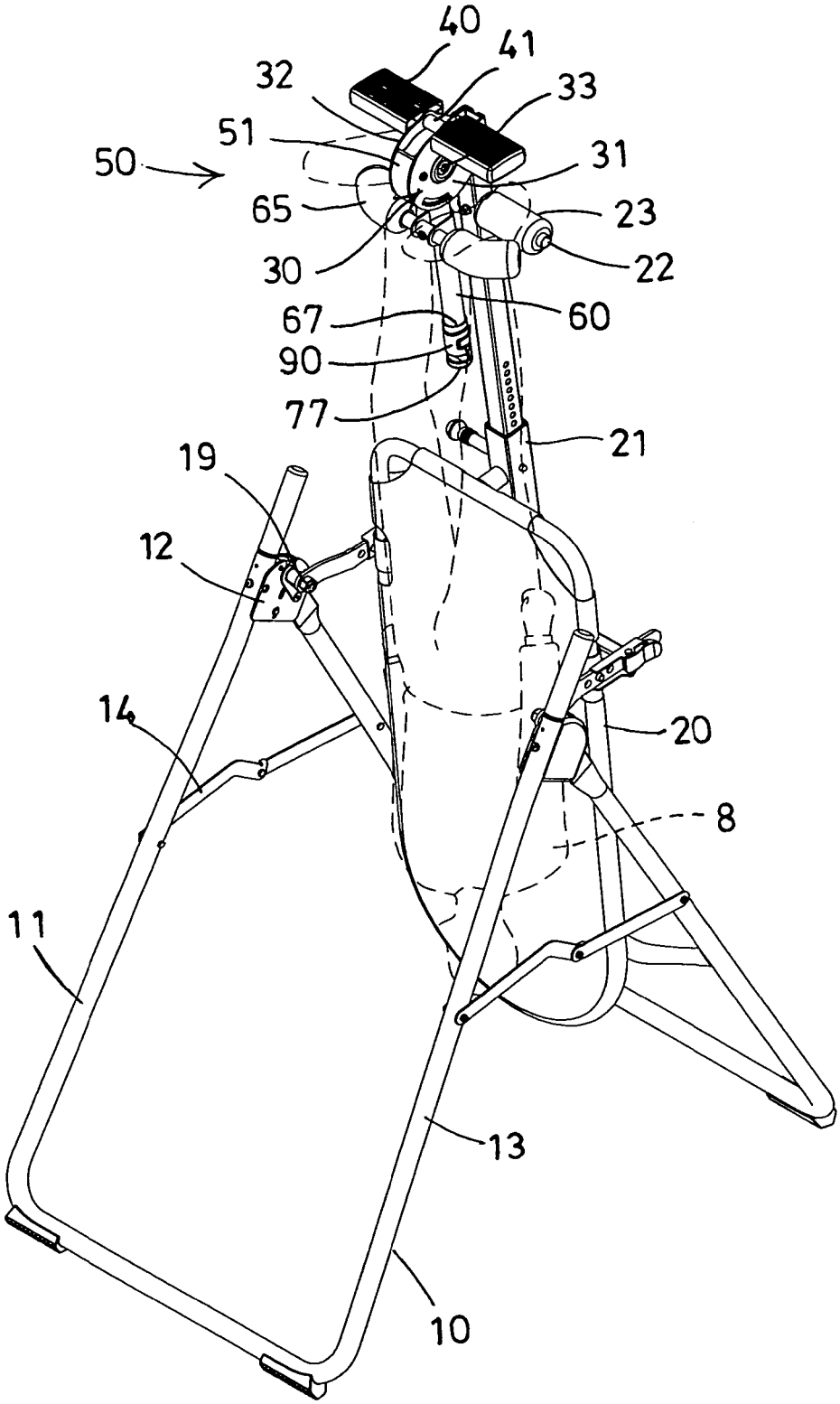

Referring to the drawings, and initially to FIGS. 1-3, a tilting inversion exerciser in accordance with the present invention comprises a lower supporting stand 10 for pivotally or rotatably supporting a table 20 thereon, and for supporting a user 8 on the table 20, the lower supporting stand 10 includes such as two pairs of legs 11 having upper ends pivotally coupled together with two apex plates 12, so as to form two inverted V-shaped or A-shaped frames 13. The table 20 may be pivotally or rotatably attached to and supported on the apex plates 12 of the lower supporting stand 10 with such as pivot axles 19, for allowing the table 20 to be pivoted or rotated relative to the pivot axles 19 and/or the apex plates 12 of the lower supporting stand 10.

The frames 13 may each include a foldable link 14 coupled between the legs 11, to retain the legs 11 in an open or working position as shown in FIGS. 1-3. The links 14 are also foldable for allowing the legs 11 to be folded relative to the apex plates 12 to a folding or storing position. The table 20 includes an extension 21, such as an adjustable or retractable extension 21 extended from the other end or lower portion of the table 20 for supporting an ankle or foot retaining device 50 and for positioning the feet of the users to the table 20. The extension 21 may be extended or adjusted relative to the table 20 for moving or adjusting the foot retaining device 50 toward or away from the table 20, according to the height or dimension of the users, for example.

Figure 4:
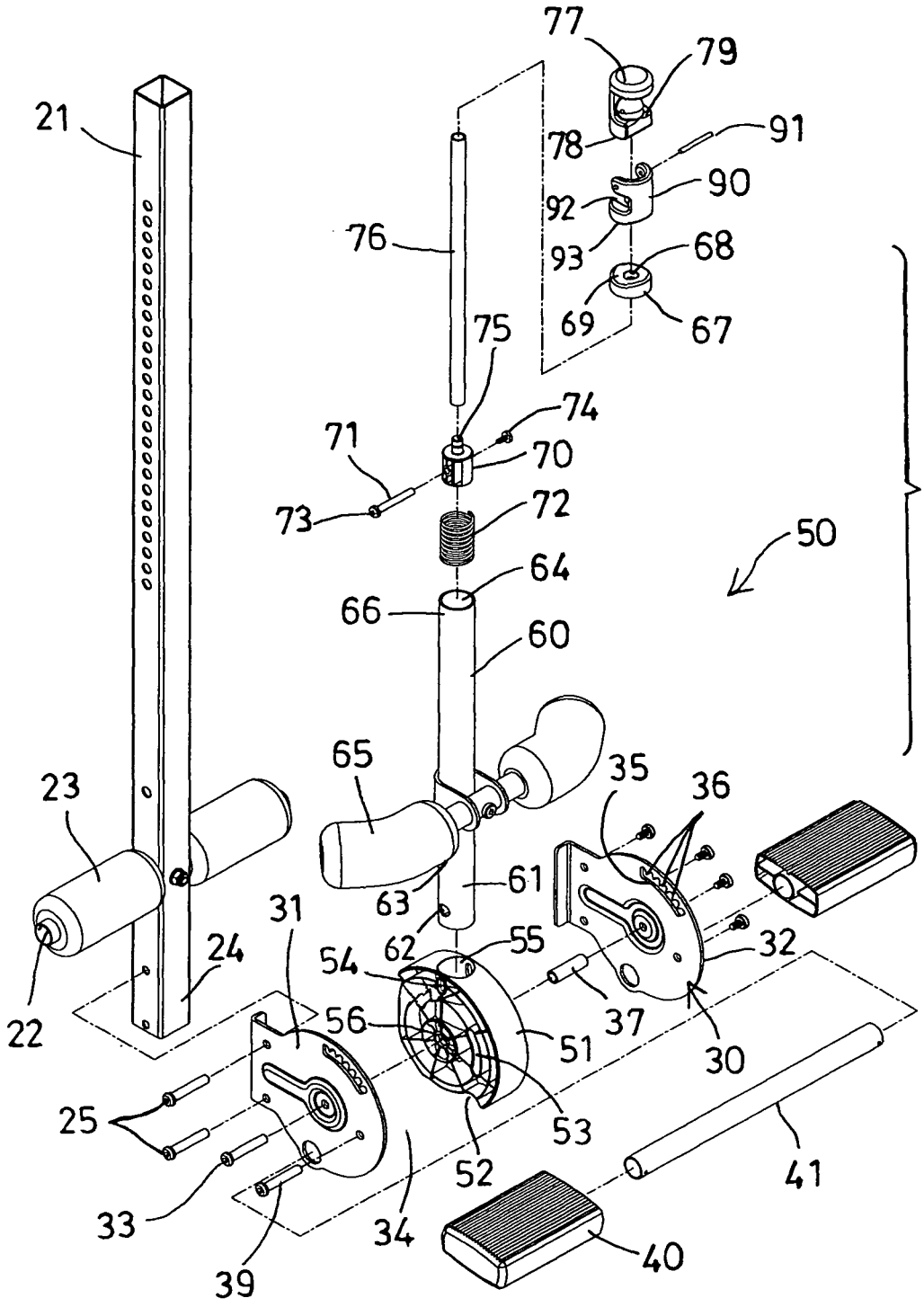
FIG. 4 is a partial exploded view illustrating the ankle holder device of the tilting inversion exerciser.
Figure 5:
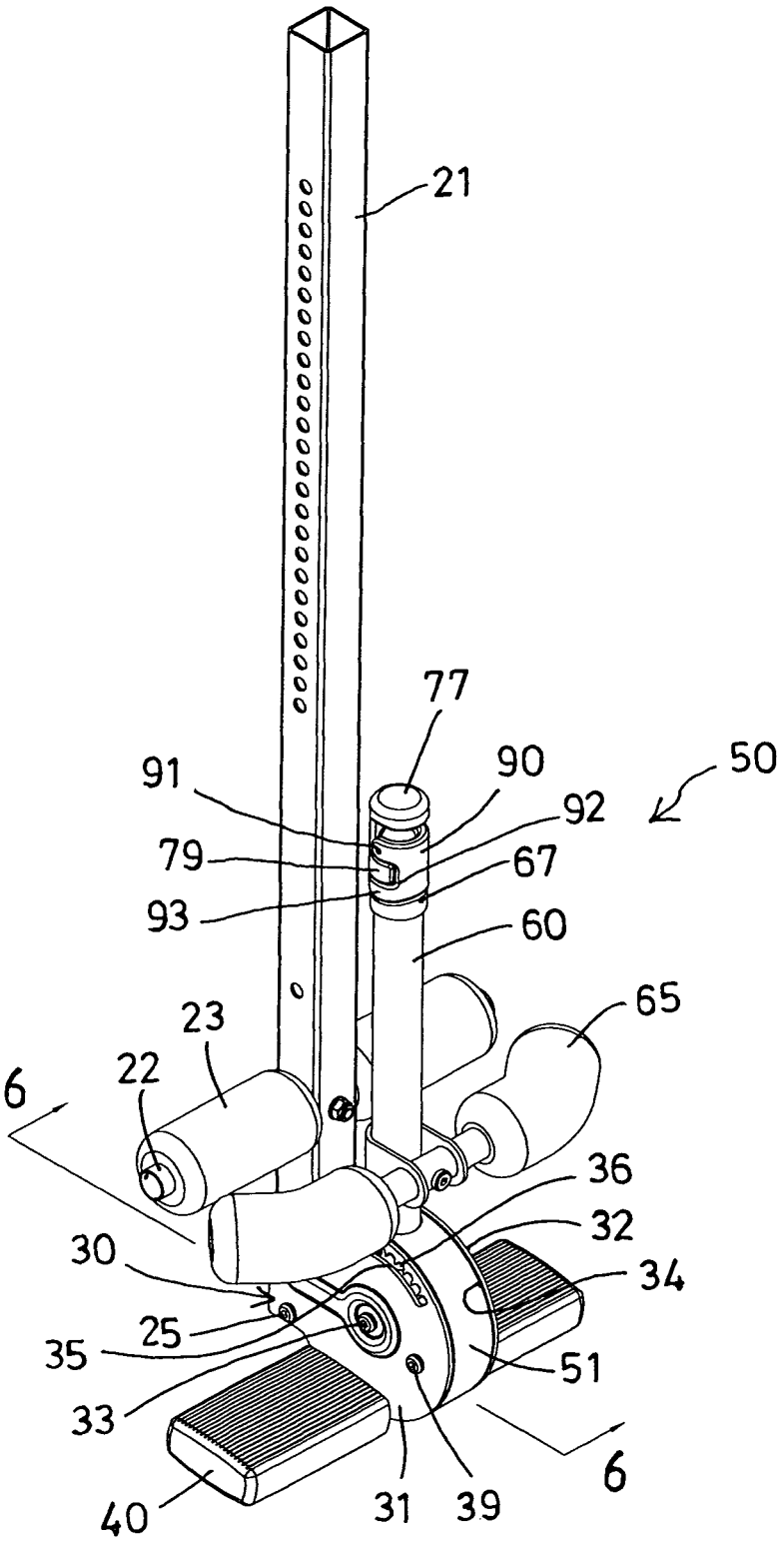
FIG. 5 is a perspective view of the ankle holder device of the tilting inversion exerciser.
Figure 6:
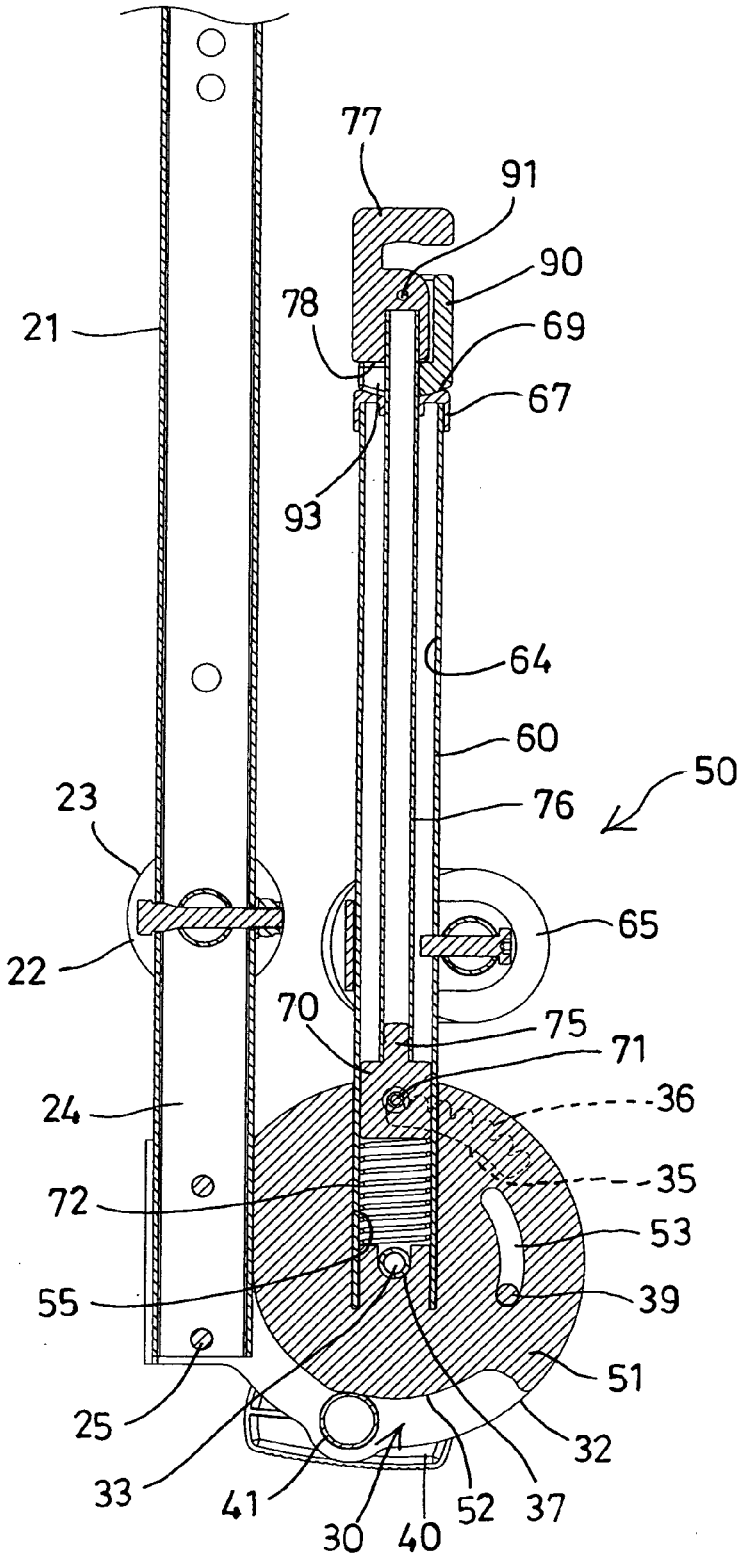
FIG. 6 is a cross sectional view of the ankle holder device of the tilting inversion exerciser, taken along lines 6-6 of FIG. 5.

As shown in FIGS. 1-3 and 4-11, the table 20 includes a fixed foot support 22 attached to the extension 21, and the fixed foot support 22 includes two soft pads 23 attached thereto to comfortably support the feet of the user, such as the ankle portions of the users. As shown in FIGS. 4-6, a carrier 30 is attached to the extension 21, such as the free end 24 of the extension 21 of the table 20 with fasteners 25, and includes two carrier panels 31, 32 spaced from each other, and includes a pivot spindle 33 attached secured to the carrier panels 31, 32, such as straddled between the carrier panels 31, 32, and disposed or located in the center portion of the carrier panels 31, 32 or of the carrier 30.

The carrier panels 31, 32 of the carrier 30 are spaced from each other for forming or defining a compartment 34 between the carrier panels 31, 32, and the pivot spindle 33 is laterally extended through the compartment 34 that is formed or defined between the carrier panels 31, 32. One or both of the carrier panels 31, 32 each may include a curved channel 35 formed therein and having a center of curvature located at the pivot spindle 33, and one or more depressions 36 formed therein and communicative with the corresponding curved channel 35 of the carrier panel 31, 32. One or more (such as two) foot pedals 40 may further be provided and attached to the carrier 30 with a beam 41, for example, for further stably engaging with and supporting the feet of the user.

The foot retaining device 50 includes a rotary member 51 disposed or engaged in the compartment 34 that is formed or defined between the carrier panels 31, 32 of the carrier 30, and pivotally or rotatably attached to the carrier panels 31, 32 with the pivot spindle 33 for allowing the rotary member 51 to be pivoted or rotated relative to the carrier 30. It is preferable, but not necessarily that a bushing or gasket 37 may further be provided and engaged onto the pivot spindle 33 for allowing the rotary member 51 to be smoothly and swiftly pivoted or rotated relative to the carrier 30. It is preferable that the rotary member 51 includes a curved notch 52 formed therein and having a center of curvature also located at the pivot spindle 33 for slidably receiving or engaging with the beam 41 (FIGS. 6-11) and for limiting the rotary member 51 to pivot or rotate relative to the carrier 30.

The rotary member 51 further includes a curved slot 53 formed therein and having a center of curvature also located at the pivot spindle 33. The carrier 30 includes a pin member 39 attached to the carrier panels 31, 32, such as straddled between the carrier panels 31, 32, and slidably engaged through the curved slot 53 of the rotary member 51 for further limiting the rotary member 51 to pivot or rotate relative to the carrier 30. The rotary member 51 further includes an oblong hole 54 laterally formed therein and aligned with or disposed or located between the curved channel 35 and the depressions 36 of the carrier panel 31, 32 of the carrier 30, and includes an orifice 55 radially formed therein and intersected or communicative with a center hole 56 thereof (FIG. 4), in which the center hole 56 of the rotary member 51 is provided for receiving or engaging with the pivot spindle 33 and/or the gasket 37.

The foot retaining device 50 further includes a lever 60 having a lower end or portion 61 engaged into the orifice 55 of the rotary member 51, and the lever 60 includes an aperture 62 (FIG. 4) formed in the lower portion 61 thereof for receiving or engaging with the pivot spindle 33 and/or the gasket 37 and for securing the lever 60 to the rotary member 51, and for allowing the rotary member 51 to be pivoted or rotated relative to the carrier 30 with the lever 60. The lever 60 further includes an opening 63 laterally formed therein (FIG. 4) and aligned with the oblong hole 54 of the rotary member 51, and includes a bore 64 formed therein, and further includes a foot anchor device 65 attached to the lever 60 and movable toward and away from the fixed foot support 22 of the extension 21 by the lever 60.

In operation, as shown in FIGS. 1 and 9-11, when the lever 60 and the foot anchor device 65 are pivoted or moved away from the fixed foot support 22 of the extension 21, the feet of the user 8 may be engaged into the space that is formed or defined between the fixed foot support 22 of the extension 21 and the foot anchor device 65 of the lever 60, and the ankle portions of the user 8 may be retained between the fixed foot support 22 of the extension 21 and the foot anchor device 65 of the lever 60 when the lever 60 and the foot anchor device 65 are pivoted or moved toward the fixed foot support 22 of the extension 21, for clamping or retaining the feet of the user 8 to the table 20 and the extension 21, and for preventing the feet of the user 8 from being disengaged from the table 20 and the extension 21.

A sliding member 70 is slidably engaged in the bore 64 of the lever 60, and a latch member 71 is attached to the sliding member 70 and extended out of the sliding member 70, and also extended out through the opening 63 of the lever 60, and slidably engaged with the oblong hole 54 of the rotary member 51, and also slidably engaged with the curved channel 35 of the carrier panel 31, 32 of the carrier 30 and for selectively engaging with either of the depressions 36 of the carrier 30, and thus for selectively retaining the rotary member 51 to the carrier 30 at the selected angular position. A spring biasing member 72 is also received or engaged in the bore 64 of the lever 60 and engaged with the sliding member 70 and/or the latch member 71 for biasing or forcing the latch member 71 to selectively engage with either of the depressions 36 of the carrier 30.

The latch member 71 includes an enlarged head 73 having an outer diameter greater than that of the curved channel 35 and the depressions 36 of the carrier panel 31, 32 of the carrier 30 for preventing the latch member 71 from being disengaged from the curved channel 35 and the depressions 36 of one of the carrier panels 31 of the carrier 30, and a fastener 74 may further be provided and attached to a free end portion of the latch member 71 and also includes an outer diameter greater than that of the curved channel 35 and the depressions 36 of the carrier panel 31, 32 of the carrier 30 for preventing the latch member 71 from being disengaged from the curved channel 35 and the depressions 36 of the other carrier panel 32 of the carrier 30 and for limiting and guiding the latch member 71 to stably engage with either of the depressions 36 of the carrier 30.

The lever 60 further includes a cap 67 engaged with the upper portion 66 of the lever 60 for blocking the bore 64 of the lever 60, and the cap 67 includes a central hole 68 formed therein and includes curved upper surface 69 formed thereon. A stem 76 is slidably engaged in the bore 64 of the lever 60 and attached to a stud 75 of the sliding member 70 and moved in concert with the sliding member 70, the stem 76 is slidably engaged through the central hole 68 of the cap 67 and extended out of the lever 60, and an actuating knob 77 is attached to the free end portion of the stem 76, and arranged for forming a space 78 between the actuating knob 77 and the cap 67 or the upper portion 66 of the lever 60 when the actuating knob 77 is biased away from the cap 67 or the upper portion 66 of the lever 60 by the spring biasing member 72. The actuating knob 77 further includes a protrusion 79 formed or provided therein.

A lock device 90 is pivotally attached to the upper portion 66 of the lever 60 or to the actuating knob 77 with a pivot shaft 91, and includes a recess 92 for selectively engaging with the corresponding protrusion 79 of the actuating knob 77 and for solidly locking the lock device 90 to the actuating knob 77 or the upper portion 66 of the lever 60, and includes another corresponding lock protrusion 93 for selectively engaging with the space 78 that is formed between the actuating knob 77 and the cap 67 or the upper portion 66 of the lever 60 and for further solidly latching the lock device 90 to the actuating knob 77 or the upper portion 66 of the lever 60.

Figure 7:
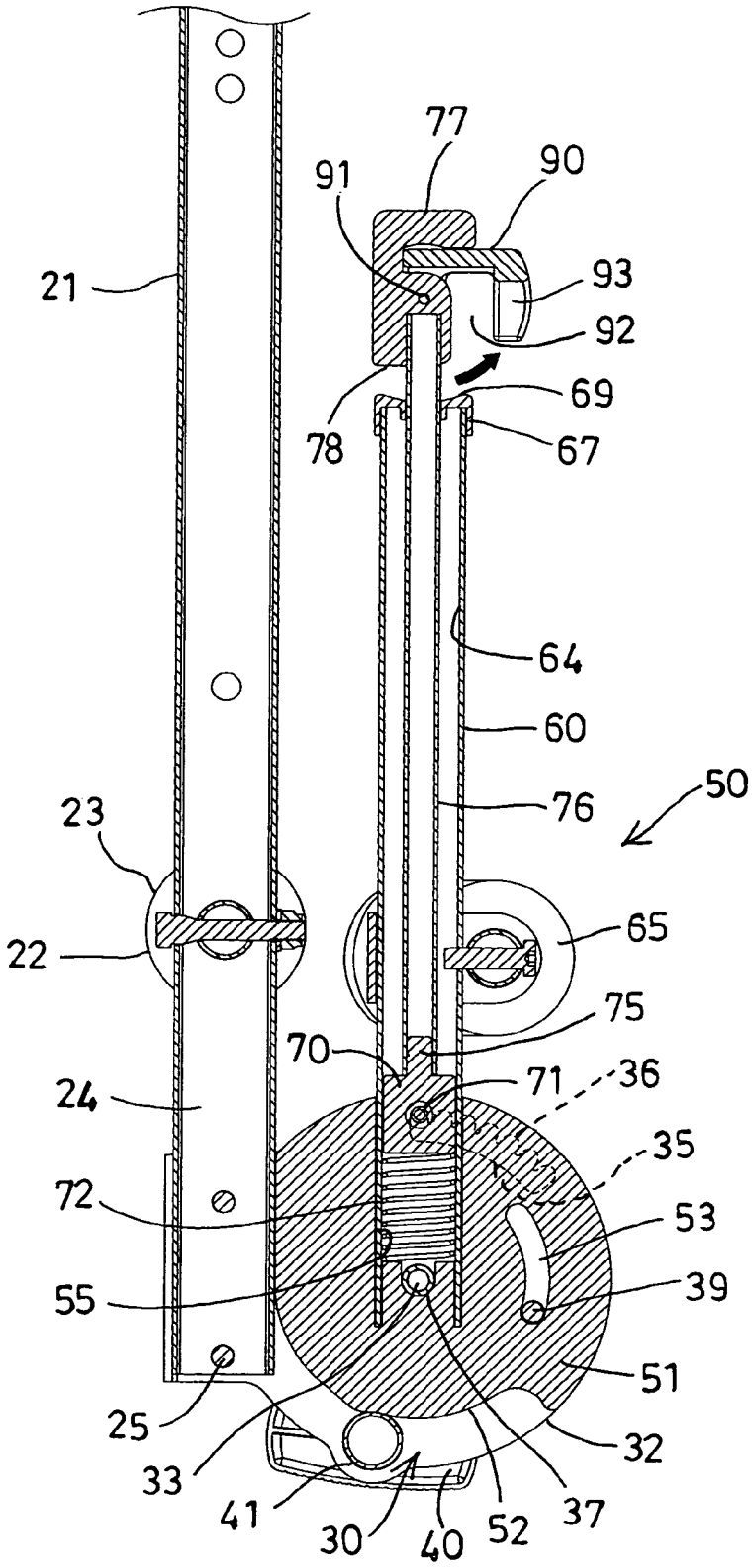
FIGS. 7, 8, 9, 10, 11 are partial cross sectional views similar to FIG. 6, illustrating the operation of the ankle holder device of the tilting inversion exerciser.
Figure 8:
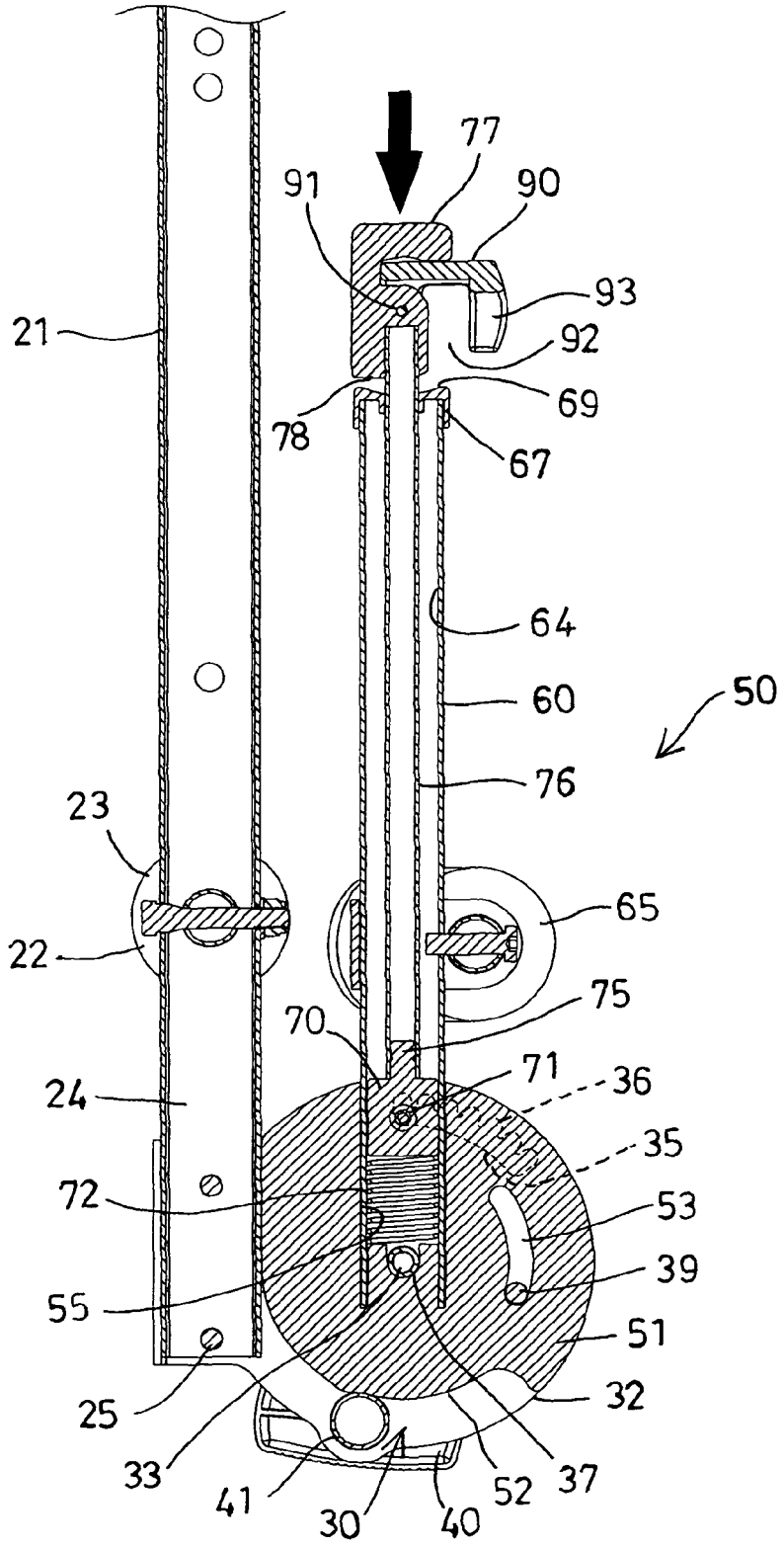
Figure 9:
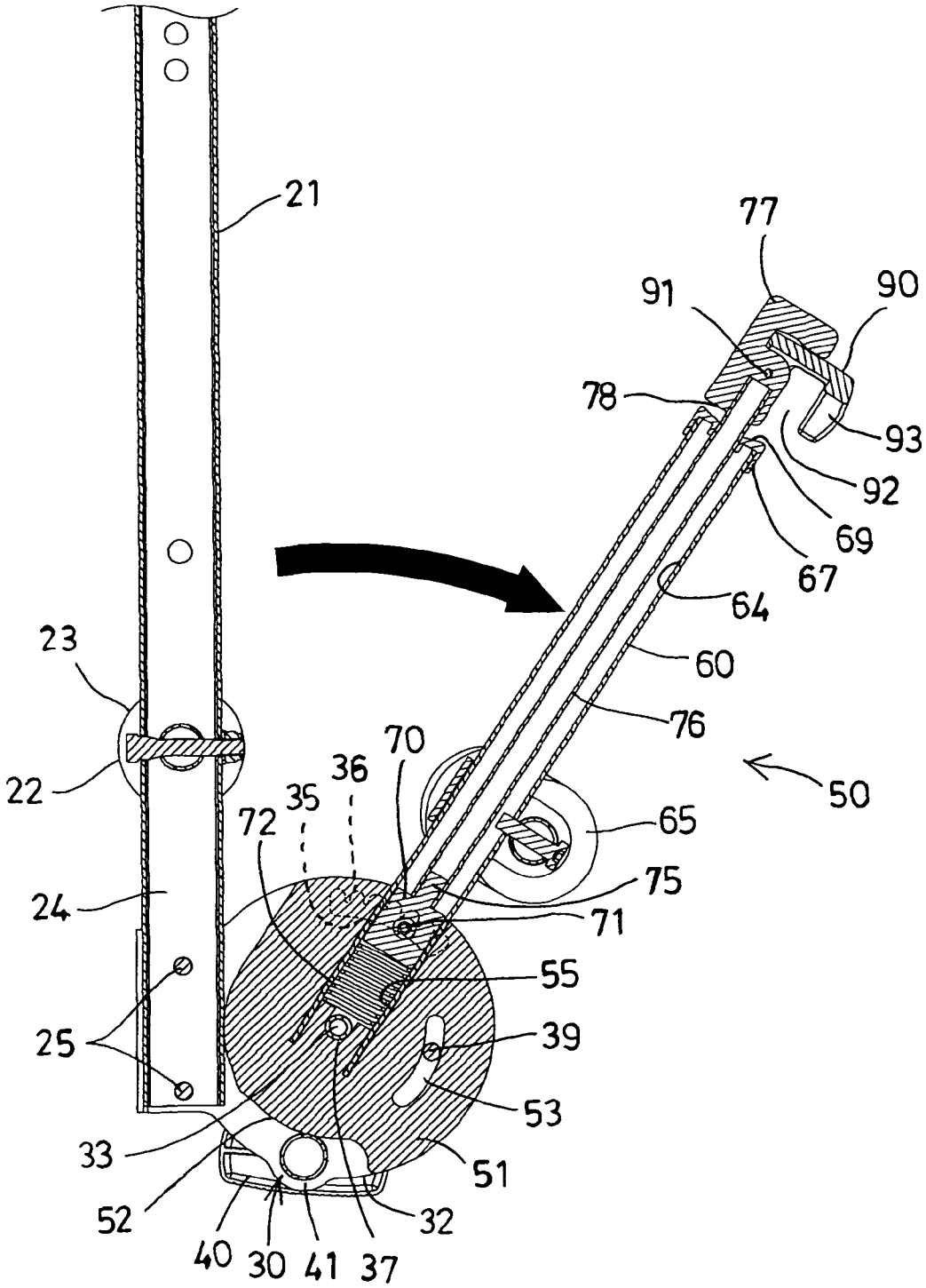

In operation, as shown in FIGS. 7 and 8, when the lock device 90 is pivoted away from the actuating knob 77 or the upper portion 66 of the lever 60, or when the recess 92 of the lock device 90 is pivoted away from the corresponding protrusion 79 of the actuating knob 77, or when the lock protrusion 93 of the lock device 90 is pivoted away from the space 78 that is formed between the actuating knob 77 and the cap 67 or the upper portion 66 of the lever 60, the sliding member 70 and the latch member 71 may be moved along or relative to the lever 60 with the stem 76 and/or the actuating knob 77, and the latch member 71 may be disengaged from the depressions 36 of the carrier panel 31, 32 of the carrier 30 and may be slidably engaged in the curved channel 35 of the carrier panel 31, 32 of the carrier 30, and thus for allowing the lever 60 and the foot anchor device 65 to be pivoted toward or away from the fixed foot support 22 of the extension 21 (FIG. 9).

The feet of the user 8 may then be engaged into the space that is formed between the fixed foot support 22 of the extension 21 and the foot anchor device 65 of the lever 60, and the ankle portions of the user 8 may be retained between the fixed foot support 22 of the extension 21 and the foot anchor device 65 of the lever 60 when the lever 60 and the foot anchor device 65 are moved toward the fixed foot support 22 of the extension 21, for retaining the feet of the user 8 to the table 20 and the extension 21, and for preventing the feet of the user 8 from being disengaged from the table 20 and the extension 21, the user may thus be solidly supported on the table 20 and/or may have his feet engaged on the foot pedals 40, and/or may have his ankle portions detachably secured to the extension 21 with the foot retaining device 50.

Figure 10:
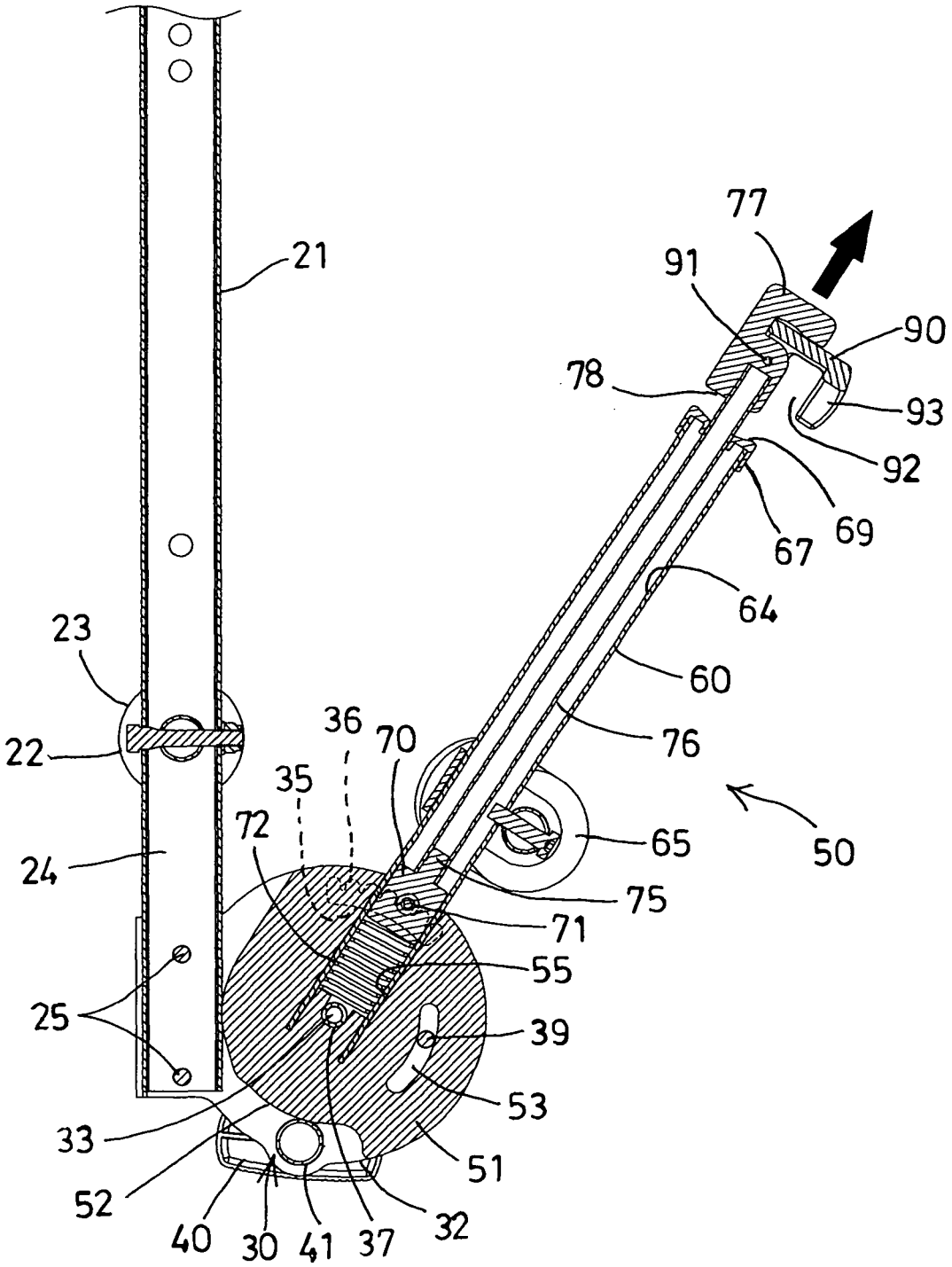

As shown in FIG. 10, when the user 8 do not move the stem 76 and/or the actuating knob 77 onto the spring biasing member 72, the spring biasing member 72 may bias and move the sliding member 70 and the latch member 71 toward the cap 67 or away from the pivot spindle 33 and the gasket 37, and may bias and move the latch member 71 to selectively engage with either of the depressions 36 of the carrier 30, and thus for adjustably retaining the rotary member 51 to the carrier 30 at the required angular position, and also for adjustably anchoring the lever 60 and the foot anchor device 65 to the fixed foot support 22 of the extension 21 at the required angular position.

At this moment, when the stem 76 and/or the actuating knob 77 is forced onto the spring biasing member 72 or moved toward the pivot spindle 33 and the gasket 37 inadvertently by the children, for example, the feet of the user 8 may have a good chance to be disengaged from the foot retaining device 50 and the table 20 particularly when the table 20 is at the downwardly headed or up-side-down or inverted position, such that the user 8 may also have a good chance to be disengaged or fall from table 20 inadvertently.

Figure 11:
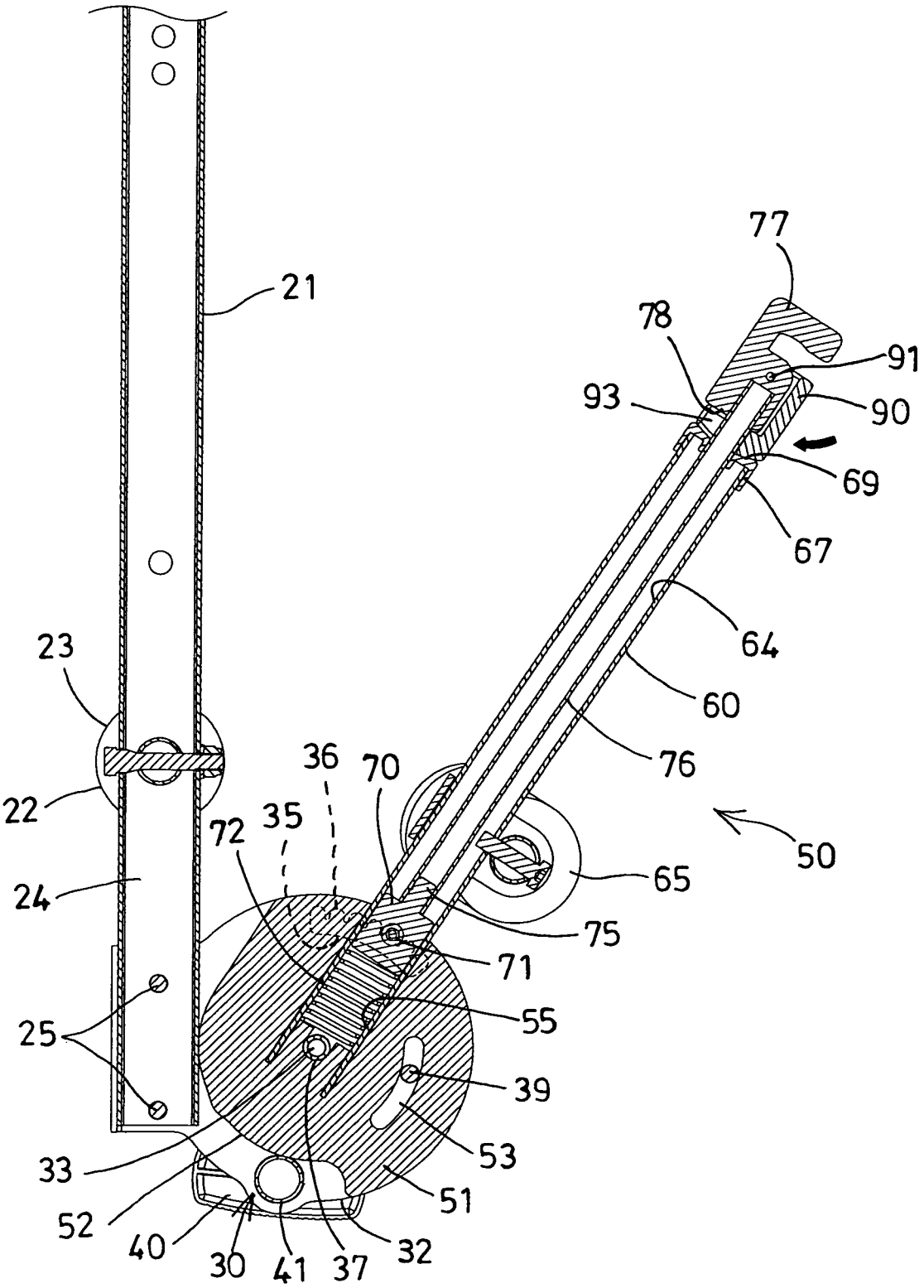

As shown in FIG. 11, when the lock device 90 is pivoted toward the actuating knob 77 or the upper portion 66 of the lever 60, the recess 92 of the lock device 90 may be pivoted toward and to engage with the corresponding protrusion 79 of the actuating knob 77, and/or the lock protrusion 93 of the lock device 90 may be pivoted toward the space 78 that is formed between the actuating knob 77 and the cap 67 or the upper portion 66 of the lever 60, at this moment, the sliding member 70 and the latch member 71 may no longer be moved along or relative to the lever 60 with the stem 76 and/or the actuating knob 77, and the latch member 71 may no longer be disengaged from the depressions 36 of the carrier panel 31, 32 of the carrier 30 and may no longer be slidably engaged in the curved channel 35 of the carrier panel 31, 32 of the carrier 30, and the lever 60 and the foot anchor device 65 may thus be solidly anchored to the fixed foot support 22 of the extension 21 at the required angular position (FIGS. 1-2, 6, 11).

It is to be noted that the user may make sure that the latch member 71 is engaged in the depressions 36 of the carrier panel 31, 32 of the carrier 30 and may no longer be slid along the curved channel 35 of the carrier panel 31, 32 of the carrier 30 when the recess 92 of the lock device 90 is engaged with the protrusion 79 of the actuating knob 77 and/or when the lock protrusion 93 of the lock device 90 is engaged with the space 78 that is formed between the actuating knob 77 and the cap 67 or the upper portion 66 of the lever 60, the stem 76 and the actuating knob 77, and the sliding member 70 and the latch member 71 and thus the carrier 30 and the lever 60 and the foot anchor device 65 may be solidly anchored to the fixed foot support 22 of the extension 21 at the selected angular position with the lock device 90 for preventing the foot retaining device 50 from being actuated by the children inadvertently, and for giving some security to the user 8 while conducting the inversion exercises and for preventing the feet of the user 8 from being disengaged from the foot retaining device 50 inadvertently, and thus for allowing the user 8 to safely operate the inversion exercises.

Accordingly, the tilting inversion exerciser in accordance with the present invention includes a rotating ankle holder or foot retaining device for detachably securing the ankle portions or the feet of the user to the foot retaining device of the tilting inversion exerciser and for giving some security to the user while conducting the inversion exercises and for preventing the feet of the user from being disengaged from the foot retaining device inadvertently, and thus for allowing the user to safely conduct or operate the inversion exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tilting inversion exerciser comprising:

a supporting stand, a table rotatably supported on said supporting stand with a pivot axle for supporting a user on said table, and including an extension extended therefrom, and including a foot support attached to said extension, and including a carrier attached to said extension, and a foot retaining device including a lever pivotally attached to said carrier with a pivot spindle, and including a foot anchor device attached to said lever and movable toward and away from said foot support of said extension with said lever when said lever is pivoted relative to said carrier, a latch member attached to said lever for selectively engaging with said carrier and for adjustably anchoring said lever and said foot anchor device to said foot support of said extension at a selected angular position, and a lock device for selectively locking said latch member to said lever and for preventing said latch member from being moved relative to said lever, wherein said carrier includes a channel formed therein for slidably receiving and engaging with said latch member, and includes a plurality of depressions formed therein and communicative with said channel of said carrier for selectively engaging with said latch member and for adjustably anchoring said lever and said foot anchor device to said foot support of said extension at the selected angular position, said foot retaining device includes a sliding member slidably received and engaged in said lever, and said latch member is attached to said sliding member, and said latch member includes an enlarged head engaging with said carrier and for preventing said latch member from being disengaged from said channel and said depressions of said carrier, said foot retaining device includes a stem slidably engaged in said lever and secured to said sliding member and moved in concert with said sliding member for moving said sliding member along and relative to said lever, said foot retaining device includes an actuating knob attached to said stem for anchoring and supporting said lock device, said lock device is pivotally mounted to said lever with a pivot shaft, said lock device includes a recess provided therein, and said actuating knob includes a protrusion provided therein for engaging with said recess of said lock device and for locking said lock device to said actuating knob, said lever includes a cap attached thereto and having a hole formed in said cap for slidably engaging with said stem and arranged for forming a space between said actuating knob and said cap, and said lock device includes a lock protrusion for selectively engaging with said space which is formed between said actuating knob and the cap and for locking said lock device to said actuating knob and said lever.

2. The tilting inversion exerciser as claimed in claim 1, wherein said carrier includes two carrier panels spaced from each other for forming a compartment between said carrier panels and for pivotally engaging with said lever.

3. The tilting inversion exerciser as claimed in claim 2, wherein said carrier panels each include said channel and said depressions formed therein.

4. The tilting inversion exerciser as claimed in claim 1, wherein said channel of said carrier is a curved channel having a curvature center located at said pivot spindle.

5. The tilting inversion exerciser as claimed in claim 1, wherein said lever includes an opening formed therein for slidably receiving and engaging with said latch member.

6. The tilting inversion exerciser as claimed in claim 1, wherein said foot retaining device includes a rotary member pivotally attached to said carrier with said pivot spindle and coupled to said lever.

7. The tilting inversion exerciser as claimed in claim 6, wherein said rotary member includes an oblong hole formed therein and aligned with said channel of said carrier for slidably receiving and engaging with said latch member.

8. The tilting inversion exerciser as claimed in claim 6, wherein said carrier includes a foot pedal attached to said carrier with a beam, and said rotary member includes a curved notch formed therein for slidably engaging with said beam and for limiting said rotary member to rotate relative to said carrier.

9. The tilting inversion exerciser as claimed in claim 6, wherein said rotary member includes a curved slot formed therein, and said carrier includes a pin member attached thereto and slidably engaged through said curved slot of said rotary member for limiting said rotary member to rotate relative to said carrier.

10. The tilting inversion exerciser as claimed in claim 1, wherein said lever includes a spring biasing member engaged with said sliding member for biasing and forcing said latch member to engage with either of said depressions of said carrier.

* * * * *